US010119255B2

(12) United States Patent
Dover

(10) Patent No.: US 10,119,255 B2
(45) Date of Patent: Nov. 6, 2018

(54) STAINLESS STEEL MOP SINK ASSEMBLY

(71) Applicant: James Chadwick Dover, Harrisburg, NC (US)

(72) Inventor: James Chadwick Dover, Harrisburg, NC (US)

( * ) Notice: Subject to any disclaimer, the term of this patent is extended or adjusted under 35 U.S.C. 154(b) by 191 days.

(21) Appl. No.: 14/993,462

(22) Filed: Jan. 12, 2016

(65) Prior Publication Data

US 2016/0208469 A1 Jul. 21, 2016

Related U.S. Application Data

(60) Provisional application No. 62/104,056, filed on Jan. 15, 2015.

(51) Int. Cl.
*E03C 1/182* (2006.01)
*E03C 1/181* (2006.01)

(52) U.S. Cl.
CPC ..... *E03C 1/182* (2013.01); *E03C 1/181* (2013.01)

(58) Field of Classification Search
CPC ..... E03C 1/181; E03C 1/182
USPC ..... 4/650, 612–614
See application file for complete search history.

(56) References Cited

U.S. PATENT DOCUMENTS 3,076,202 A * 2/1963 Sorrells ..... E03C 1/182 4/640
4,152,789 A * 5/1979 Heath ..... A47K 3/284 4/614
4,423,528 A * 1/1984 Wiedmeier ..... A47K 3/284 4/613
2006/0213006 A1* 9/2006 Rush, Jr. ..... A47K 3/40 4/613
2010/0132110 A1* 6/2010 Schwaegler ..... E03C 1/18 4/619

* cited by examiner

*Primary Examiner* — Tuan N Nguyen

(57) ABSTRACT

A mop sink assembly having a mop sink with a back wall, a left side wall, a right side wall, a front wall; and a bottom with a drain opening. The mop sink is comprised of a heavy gauge stainless steel; preferably 12 gauge 304 stainless steel. The mop sink assembly may further include a backsplash and a seamless joint seal. In practice the backsplash and the seamless joint seal are beneficially made of a fiberglass reinforced plastic.

9 Claims, 4 Drawing Sheets

STAINLESS STEEL MOP SINK ASSEMBLY

CROSS REFERENCE TO RELATED APPLICATIONS

This application claims priority to U.S. Provisional Patent Application No. 62/104,056, filed on Jan. 15, 2015, the entire contents of which are incorporated by reference herein.

FIELD OF THE INVENTION

The presently disclosed subject matter is directed to sinks. More particularly, it is directed to specialized mop sinks and sink assemblies having seamless joints.

BACKGROUND OF THE INVENTION

Restaurants, bars, other food service industries as well as many commercial establishments face the daunting task of cleanliness. For esthetics as well as health a clean establishment is a must.

This application claims priority to U.S. Provisional Patent Application No. 62/104,056, filed on Jan. 15, 2015, the entire contents of which are incorporated by reference herein.

One ever present factor for commercial establishments as well as at home is that things often end up on the floor. Whether dirt is tracked in, liquids are spilled, or food simply falls from shelves, floors get dirty and food stuffs and liquids on the floor present risks of slipping as well as bacterial and mold build up.

As is well known floors are usually cleaned using mops. Mops have proven to be very successful at keeping floors clean and sanitary. They are quick to use, effective, low cost, long lasting and easily handled by even untrained workers. Mops are so successful that many establishments have built-in mop sinks.

In the prior art most built-in mop sinks were made from concrete. Cheap, easily fabricated, long lasting, extremely rugged and water resistant, concrete mop sinks have proved their utility over the years. However, concrete mop sinks are heavy and difficult to install. Keeping concrete mop sinks clean, mold-free and sanitary has always been a problem.

In particular, concrete mop sinks have ledges and develop cracks that compound sanitary problems. With the ever more stringent safety standards being put in place along with high legal liability for harm caused by poor sanitary conditions, many commercial establishments have rightly questioned whether concrete mop sinks are optimal.

Exacerbating the problem of concrete mop sinks is the wide use of fiberglass reinforced plastic (FRP). Because of its low cost, high resistance to moisture, ease of use and ability to be molded with special features such as grooves FRP is very often used for forming sinks, backsplashes and other areas that need water resistance.

However, using a FRP backsplash with a concrete mop sink unavoidably creates ledges and gaps that foster bacterial and mold growth. Those ledges and gaps resist cleaning and sanitizing which results in unappealing looks and smells as well as being a potential source for harmful contamination.

Accordingly, there exists a need for a new type of mop sink that can be installed in almost any structural situation. Ideally such a mop sink would not support bacterial growth, could be easily cleaned of mold, would be structurally sound, could take rugged treatment and could survive environmental factors such as hot, cold, and solar radiation. Ideally such a mop sink would be part of a mop sink assembly have seamless joints to reduce cleaning effort and reduce bacterial and mold growth.

BRIEF SUMMARY OF THE INVENTION

The principles of the present invention provide for improved mop sinks and mop sink assemblies suitable for installation in almost any structural situation. The inventive mop sink is made of a heavy gauge, seamless stainless steel, preferable 12 gauge 304 stainless steel. The inventive mop sink does not readily support bacterial growth, can be easily cleaned, is structurally sound, can take rugged treatment, can survive environmental factors such as hot, cold, solar radiation and is highly chemical resistant yet is flexible enough to be installed with relative ease compared to more rigid sinks.

A mop sink in accord with the present invention has a back wall, a left side wall, a right side wall, a front wall, and a bottom with a drain opening. The mop sink is comprised of a heavy gauge stainless steel, preferably 12 gauge 304 stainless steel to provide both strength and flexibility to assist installation.

A mop sink assembly in accord with the present invention includes a steel sink having a back wall, a left side wall, a right side wall, a front wall; and a bottom having a drain opening as well as a top perimeter. The mop sink assembly also includes a fiberglass backsplash that is disposed above the top perimeter and an elongated joint between the backsplash and the top perimeter. In practice the steel sink is stainless steel, beneficially 12 gauge 304 stainless steel for both strength and flexibility. The elongated joint may be comprised of fiberglass reinforced plastic. Preferably the elongated joint has a body with a rectangular cross-section, a convex cap that extends forward from the body, and sides that extend between the body and the cap. In use the body extends along part of the top perimeter and along the backsplash such that the sides also extend along the top perimeter and along the backsplash. The joint beneficially forms a waterproof seal between the mop sink and the backsplash.

In another embodiment a mop sink assembly in accord with the present invention includes a stainless steel sink having a back wall, a left side wall, a right side wall, a front wall, a bottom with a drain opening, and a top perimeter. Also included are a backsplash disposed above the top perimeter and an elongated joint disposed between the backsplash and the top perimeter such that the joint forms a waterproof seal between the backsplash and a portion of the top perimeter.

Preferably the stainless steel is 12 gauge 304 stainless steel to provide both strength and flexibility and the elongated joint and backsplash are comprised of fiberglass reinforced plastic. The elongated joint has a body with a rectangular cross-section, a convex cap that extends forward from the body, and sides that extend between the body and the cap. The body extends along the top perimeter and along the backsplash while the sides extend along the top perimeter and along the backsplash.

BRIEF DESCRIPTION OF THE DRAWINGS

The advantages and features of the present invention will become better understood with reference to the following detailed description and claims when taken in conjunction with the accompanying drawings, in which like elements are identified with like symbols, and in which:

DETAILED DESCRIPTION OF THE INVENTION

The preferred embodiment of the present invention is depicted in FIGS. 1 through 4. However, the invention is not limited to the specifically described embodiment. A person skilled in the art will appreciate that other embodiments of the invention are possible without deviating from the basic concept of the invention. Any such work around also falls within the scope of this invention.

The terms "a" and "an" as used herein do not denote a limitation of quantity, but rather denote the presence of at least one of the referenced items. In addition, unless otherwise denoted all directional signals such as in, out, up, down, left, and right are taken with reference to FIG. 1.

Figure 1:
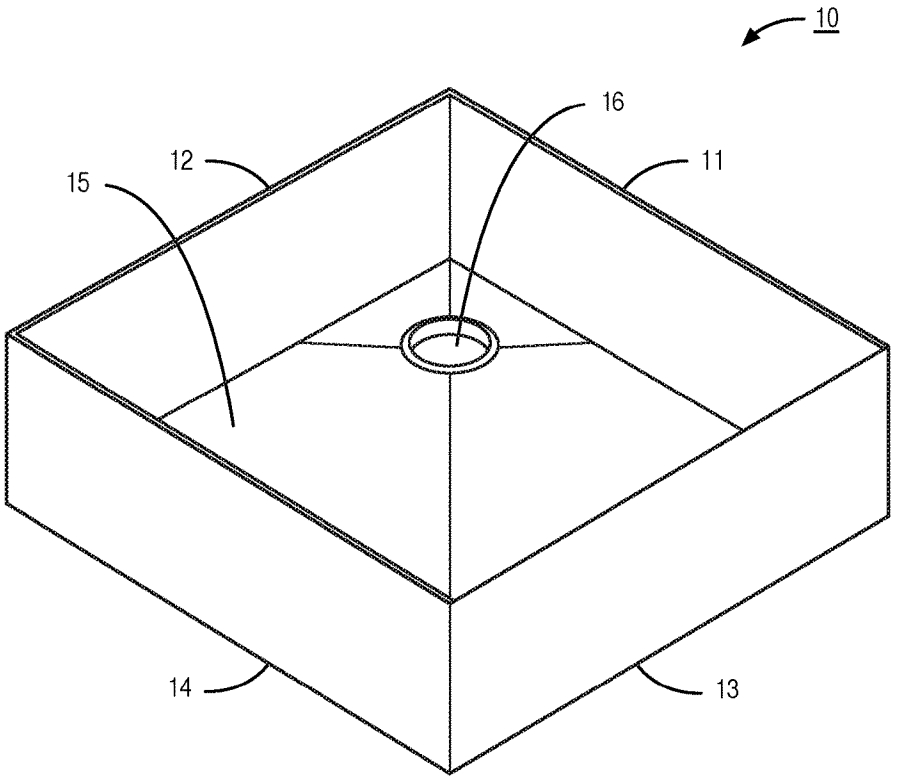
FIG. 1 illustrates a mop sink 10 that is in accord with the principles of the present invention.

Referring now to FIG. 1, the present invention describes a stainless steel mop sink 10. The mop sink 10 includes a back wall 11, a left side wall 12, a right side wall 13, a front wall 14, and a bottom 15 having a drain opening 16. The back wall 11, left side wall 12, right side wall 13, and front wall 14 define a top perimeter. As the mop sink 10 is to be installed as a built in mop sink in a commercial facility both ruggedness and some flexibility to aid ease of installation are paramount. To that end the mop sink 10 is comprised of a heavy gauge stainless steel, preferably 12 gauge (0.095 inch thick). Furthermore, since the mop sink 10 will be subjected to harsh chemicals in an aqueous environment, since both mold and bacterial growth should be suppressed, and since formability is important the mop sink 10 is preferably comprised of 304 stainless steel. In fact, 12 gauge 304 stainless steel provides a highly beneficial and possibly the optimum combination of strength and flexibility for the given application.

A typical mop sink 10 would have a square top-down profile of about 36 inches on a side and have walls (back wall 11, left side wall 12, right side wall 13, and front wall 14) about 12 inches high. Those dimensions combined with the 12 gauge 304 stainless steel construction provides a very rugged, relatively lightweight structure but one that has a small but vital flexibility to assist installation. The mop sink 10 usually can be fit into a predetermined position with relative ease.

Figure 2:
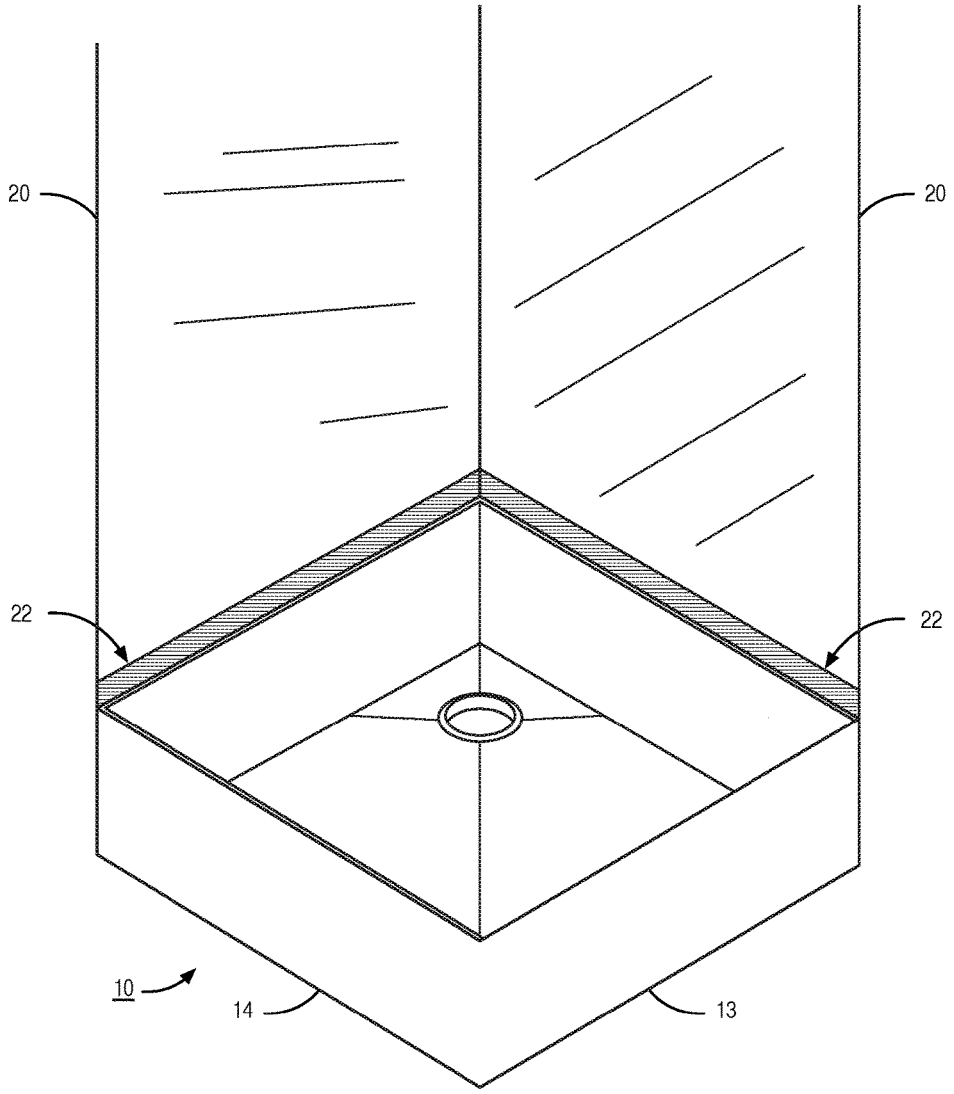
FIG. 2 illustrates the mop sink 10 of FIG. 1 installed with a FRP backsplash 20.

Turning now to FIG. 2, the mop sink 10 is beneficially used with FRP backsplashes 20. While only two FRP backsplashes 20 are shown, that is only for purposes of illustration. A third FRP backsplash 20 might extend upwards from the right side wall 13.

An important feature of the combination of the mop sink 10 and the FRP backsplashes 20 is that those components can be joined with seamless joints 22. Seamless joints 22 are not readily possible with cement mop sinks. Cement mop sinks are heavy, have wide top perimeter ledges, and have no flex workability. The inventive improvement means that the mop sink 10 will not corrode, water cannot get behind the mop sink 10, thus reducing mold and bacterial growth, and cleaning of the mop sink 10 can readily be accomplished.

Figure 3:
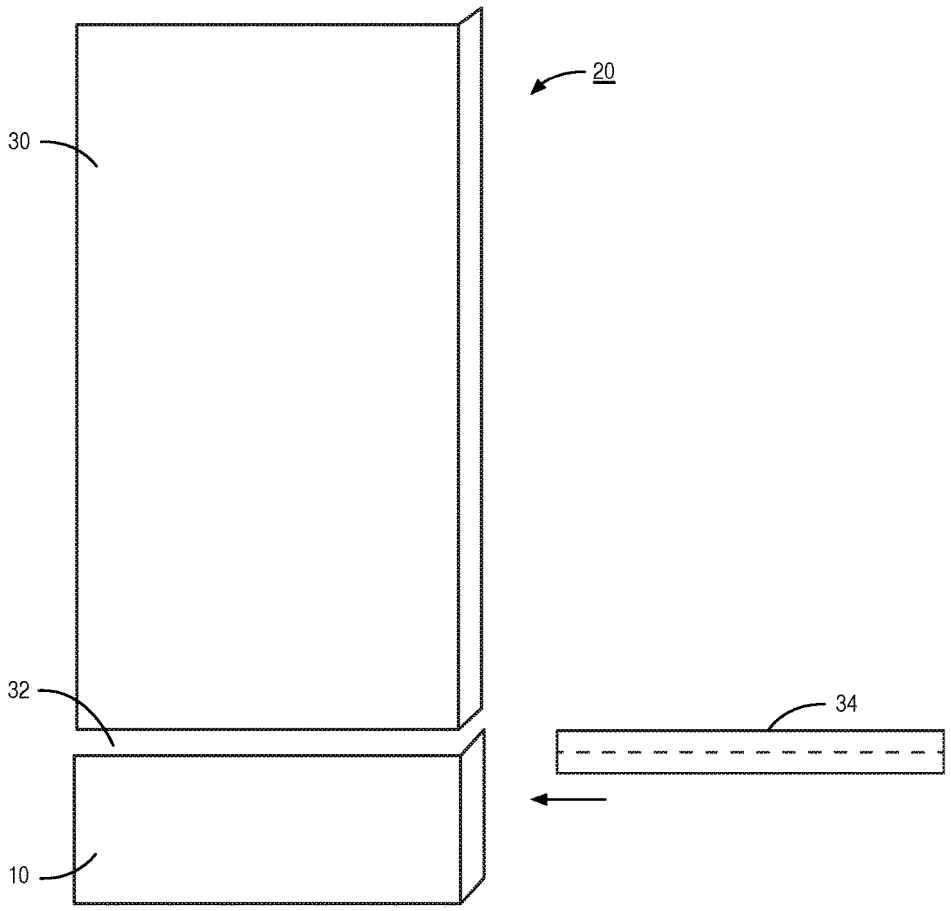
FIG. 3 illustrates the FRP backsplash 20.

Referring now to FIG. 3, each FRP backsplash 20 includes a front surface 30 that rests just above a wall of the mop sink 10. Between the bottom of the FRP backsplash 20 and the top of the mop sink 10 is a gap or groove 32. Disposed within that groove 32 is a FRP joint 34.

Figure 4:
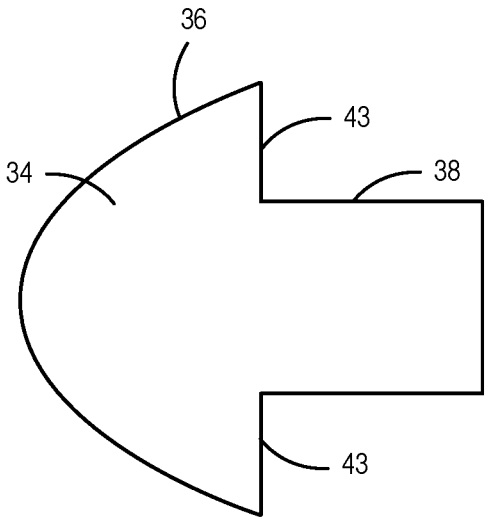
FIG. 4 illustrates a cross-sectional view of a seamless joint.

Turn now to FIG. 4 for a cross-sectional view of the FRP joint 34. The FRP joint 34 is a mushroom-shaped seal having a base 38 with a rectangular cross-section and a convex front cap 36. As the cross-section of the front cap 36 is wider than the base 38 the joint 34 includes vertical sides 43 that extend between the front cap 36 and the base 38.

In use, the bottom of the base 38 sits on part of the top perimeter of the mop sink 10 while the FRP backsplash 20 sits on top of the base 38. The front cap 36 extends over adjacent portions of the FRP backsplash 20 and the part of the top perimeter of the mop sink in contact with the base 38. The sides 43 and the base 38 form a waterproof seamless joint 22 (see FIG. 2) between the portion of the top perimeter of the mop sink 10 and the FRP backsplash 20. The sides 43 and the base 38 may be coated with a silicon sealant if need or if desired.

The foregoing description of a specific embodiment of the present invention has been presented for purposes of illustration and description. It is not intended to be exhaustive or to limit the invention to the precise forms disclosed. Obviously many modifications and variations are possible in light of the above teaching. The embodiment was chosen and described in order to best explain the principles of the invention and its practical application, to thereby enable others skilled in the art to best utilize the invention and various embodiments with various modifications as are suited to the particular use contemplated.

What is claimed:

1. A mop sink assembly, comprising:

a stainless steel sink having a top perimeter formed by a back wall, a left side wall, a right side wall, and a front wall, said stainless said steel sink further including a sink bottom having a drain opening;

at least one fiberglass backsplash having a bottom edge disposed above said top perimeter so as to form a gap between said stainless steel sink and said backsplash; and an elongated waterproof joint seal inserted into and extending from said gap, said joint seal having a mushroom-shaped convex cap that covers at least part of said bottom edge and at least part of said top perimeter.

2. The mop sink assembly according to claim 1, wherein said stainless steel is 304 stainless steel.

3. The mop sink assembly according to claim 2, wherein said 304 stainless steel is 12 gauge 304 stainless steel.

4. The mop sink assembly according to claim 1, wherein said joint seal is comprised of fiberglass reinforced plastic.

5. A mop sink assembly, comprising:

a stainless steel sink having a back wall, a left side wall, a right side wall, a front wall, a sink bottom with a drain opening, and a top perimeter formed by said back wall, by said left side wall and by said right side wall;

a backsplash having a bottom edge disposed above said top perimeter so as to form a gap; and a mushroom-shaped elongated joint inserted into said gap, said joint having a convex cap that covers at least part of said bottom edge and at least part of said perimeter, and sides that extend into said gap;

wherein said elongated joint forms a waterproof seal between said backsplash and said stainless steel sink.

6. The mop sink assembly according to claim 5, wherein said stainless steel is 304 stainless steel.

7. The mop sink assembly according to claim 6, wherein said 304 stainless steel is 12 gauge 304 stainless steel.

8. The mop sink assembly according to claim 5, wherein said elongated joint is comprised of fiberglass reinforced plastic.

9. The mop sink assembly according to claim 5, wherein said backsplash is comprised of fiberglass reinforced plastic.

* * * * *